US012078435B2

(12) United States Patent
Torres et al.

(10) Patent No.: US 12,078,435 B2
(45) Date of Patent: Sep. 3, 2024

(54) FIREARM TRIGGER ASSEMBLY

(71) Applicant: RISE Armament, LLC, Broken Arrow, OK (US)

(72) Inventors: Matthew Thomas Torres, Tulsa, OK (US); Ryan Lee Fisher, Bixby, OK (US)

(73) Assignee: RISE ARMAMENT, LLC, Broken Arrow, OK (US)

( * ) Notice: Subject to any disclaimer, the term of this patent is extended or adjusted under 35 U.S.C. 154(b) by 0 days.

(21) Appl. No.: 18/382,728

(22) Filed: Oct. 23, 2023

(65) Prior Publication Data

US 2024/0053116 A1 Feb. 15, 2024

Related U.S. Application Data

(63) Continuation of application No. 17/970,094, filed on Oct. 20, 2022, now abandoned.

(60) Provisional application No. 63/263,165, filed on Oct. 28, 2021.

(51) Int. Cl.

| | |
|---|---|
| ***F41A 19/16*** | (2006.01) |
| ***F41A 19/10*** | (2006.01) |
| ***F41A 19/14*** | (2006.01) |

(52) U.S. Cl.

CPC ..... *F41A 19/10* (2013.01); *F41A 19/14* (2013.01)

(58) Field of Classification Search

CPC ..... F41A 19/10; F41A 19/16; F41A 19/17; F41A 17/22; F41A 17/46

USPC ..... 42/69.01–69.03

See application file for complete search history.

(56) References Cited

U.S. PATENT DOCUMENTS

| | | | | |
|---|---|---|---|---|
| 4,005,540 A * | 2/1977 | Robinson | F41A 19/16 42/69.01 |
| 11,274,894 B1 * | 3/2022 | Hill | F41A 17/46 |
| 2023/0080197 A1 * | 3/2023 | Anderson | F41A 17/46 42/69.01 |

* cited by examiner

*Primary Examiner* — Reginald S Tillman, Jr.

(74) *Attorney, Agent, or Firm* — Bennet K. Langlotz; Langlotz Patent & Trademark Works, LLC

(57) ABSTRACT

A firearm trigger assembly has a frame, a hammer pivotally connected to the frame, a trigger element pivotally connected to the frame and operable to selectively restrain and release the hammer in response to movement of the trigger element between a restraint position and a release position, a trigger lever movably connected to the trigger element and movable with respect to the trigger element between a first unactuated position and a second actuated position, and the trigger element being configured to remain in the restraint position when the trigger lever is in the first unactuated position, in any of a range of positions intermediate the first unactuated position and the second actuated position, and when in the second actuated position with an application of force to the trigger lever below a selected force threshold.

13 Claims, 16 Drawing Sheets

FIREARM TRIGGER ASSEMBLY

CROSS-REFERENCE TO RELATED APPLICATION

This application is a Continuation of U.S. patent application Ser. No. 17/970,094 filed on Oct. 20, 2022, entitled "FIREARM TRIGGER ASSEMBLY," which claims the benefit of U.S. Provisional Patent Application No. 63/263,165 filed on Oct. 28, 2021, entitled "2-STAGE RIFLE TRIGGER ASSEMBLY," which are hereby incorporated by reference in their entirety for all that is taught and disclosed therein.

FIELD OF THE INVENTION

The present invention relates to firearms, and more particularly to a firearm trigger assembly that has two stages to provide feedback to the shooter without adversely affecting the trigger's reset time by increasing trigger travel to reset.

BACKGROUND AND SUMMARY OF THE INVENTION

Rifle triggers are available in single-stage and two-stage forms. Single-stage triggers feature an unchanging pull weight throughout the entire trigger motion until the rifle discharges. In contrast, two-stage triggers typically feature a lower pull weight during the first stage's range of motion that terminates in a "wall" at the end of the first stage. This significant change in pull weight signals the shooter that additional trigger movement will discharge the firearm.

AR-15 rifles typically come with a mil-spec, single-stage trigger. This has the disadvantage of having a high pull weight relative to many alternative single-stage triggers. AR-15 mil-spec triggers also require a substantial range of trigger motion to discharge the rifle because of the extended length of the sear point on the hammer. Replacement AR-15 rifle single-stage triggers provide a high degree of responsiveness and reset speed for a follow-on shot, but they lack the feedback and increased safety provided by a two-stage trigger. Conventional replacement AR-15 rifle two-stage triggers have the disadvantage of having a longer reset time for a follow-on shot compared to single-stage triggers. An additional disadvantage of conventional 2-stage triggers is the requirement to use the disconnector spring for the second stage, which forces opposing benefits: having a clear, distinct wall, or having a fast, crisp trigger reset. This requirement also affects the pull weight. Thus, there are a lot of undesirable compromises associated with a conventional 2-stage trigger.

Therefore, a need exists for a new and improved firearm trigger assembly that has two stages to provide feedback to the shooter without adversely affecting the trigger's reset time by increasing trigger travel to reset. In this regard, the various embodiments of the present invention substantially fulfill at least some of these needs. In this respect, the firearm trigger assembly according to the present invention substantially departs from the conventional concepts and designs of the prior art, and in doing so provides an apparatus primarily developed for the purpose of having two stages to provide feedback to the shooter without adversely affecting the trigger's reset time.

The present invention provides an improved firearm trigger assembly, and overcomes the above-mentioned disadvantages and drawbacks of the prior art. As such, the general purpose of the present invention, which will be described subsequently in greater detail, is to provide an improved firearm trigger assembly that has all the advantages of the prior art mentioned above.

To attain this, the preferred embodiment of the present invention essentially comprises a frame, a hammer pivotally connected to the frame, a trigger element pivotally connected to the frame and operable to selectively restrain and release the hammer in response to movement of the trigger element between a restraint position and a release position, a trigger lever movably connected to the trigger element and movable with respect to the trigger element between a first unactuated position and a second actuated position, the trigger element being configured to remain in the restraint position when the trigger lever is in the first unactuated position, in any of a range of positions intermediate the first unactuated position and the second actuated position, and when in the second actuated position with an application of force to the trigger lever below a selected force threshold, and the trigger lever being operable to move the trigger element to the release position in response to an application of force to the trigger lever greater than the selected force threshold. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
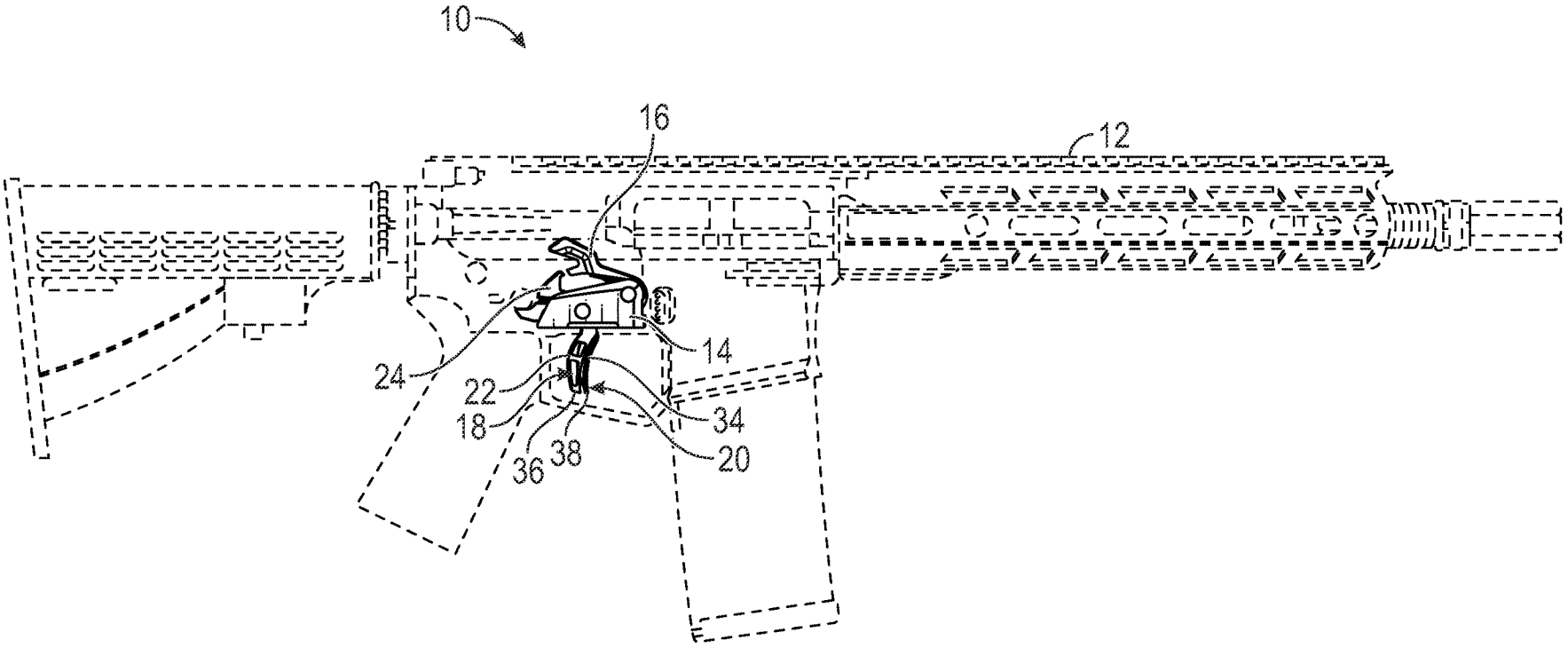
FIG. 1 is a left side view of the current embodiment of a firearm trigger assembly constructed in accordance with the principles of the present invention in use installed in a rifle.
Figure 2:
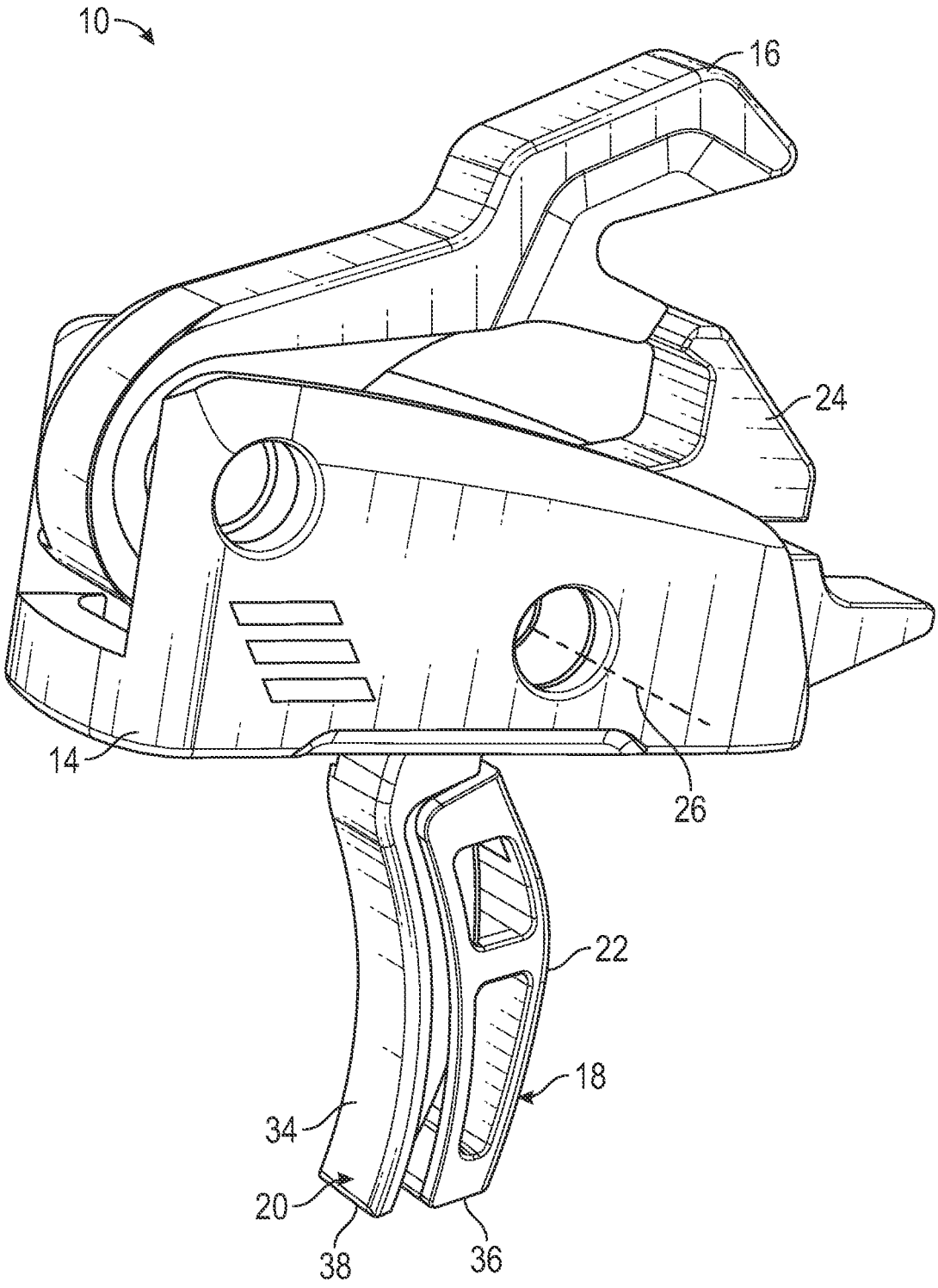
FIG. 2 is a top isometric view of the firearm trigger assembly of FIG. 1 detached from the rifle.
Figure 3:
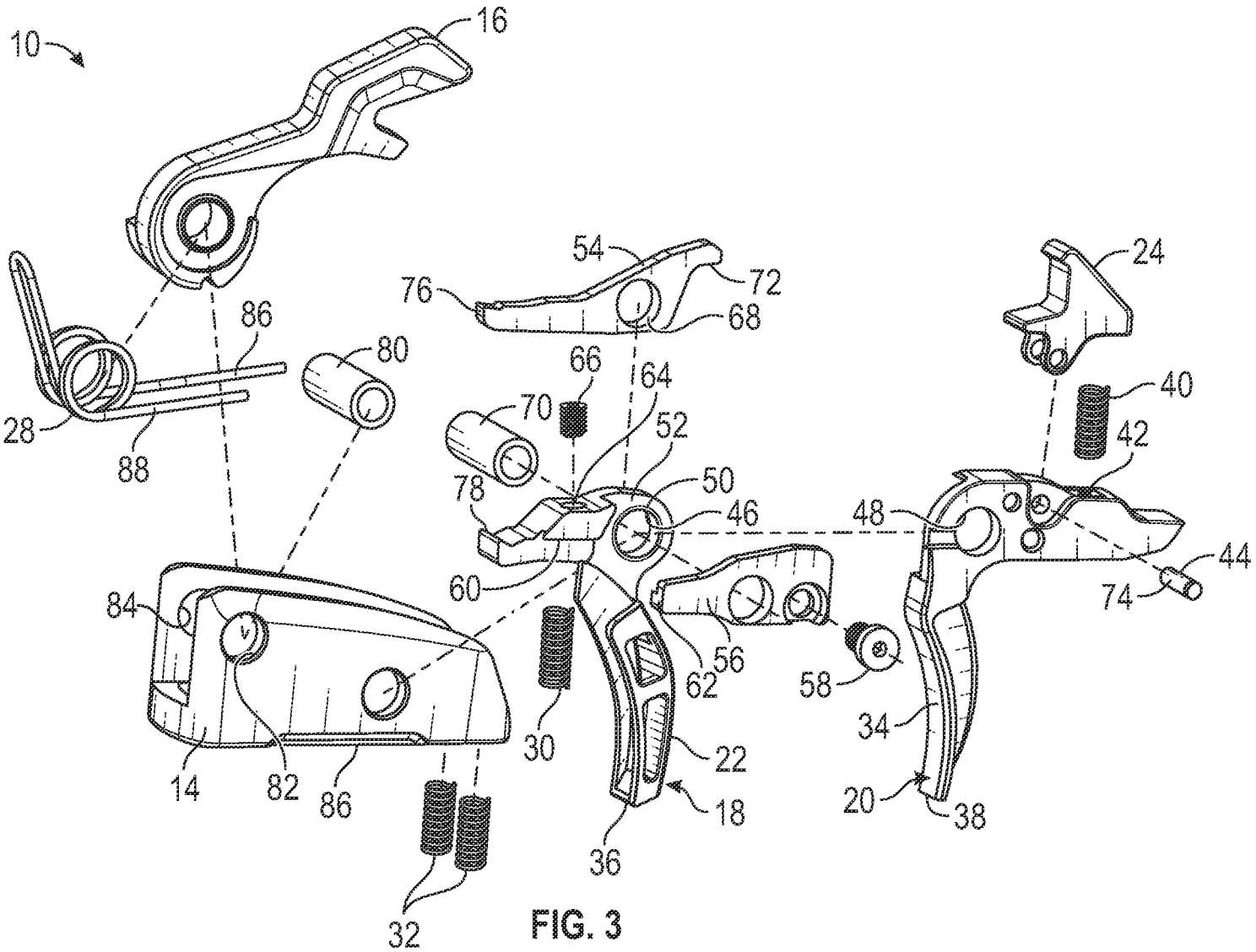
FIG. 3 is an exploded view of the firearm trigger assembly of FIG. 1 detached from the rifle.
Figure 4:
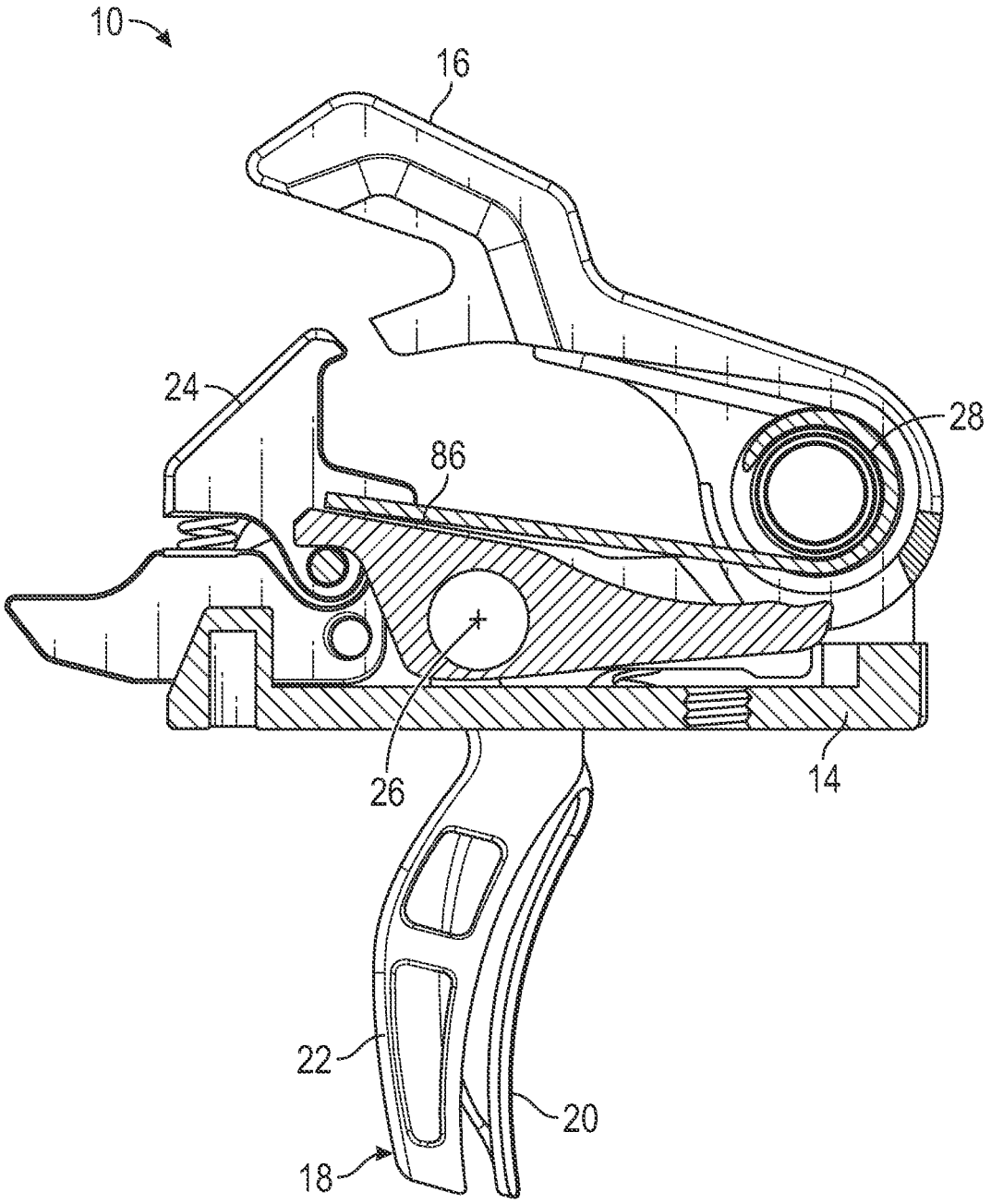
FIG. 4 is a side sectional view of the firearm trigger assembly of FIG. 1.
Figure 5:
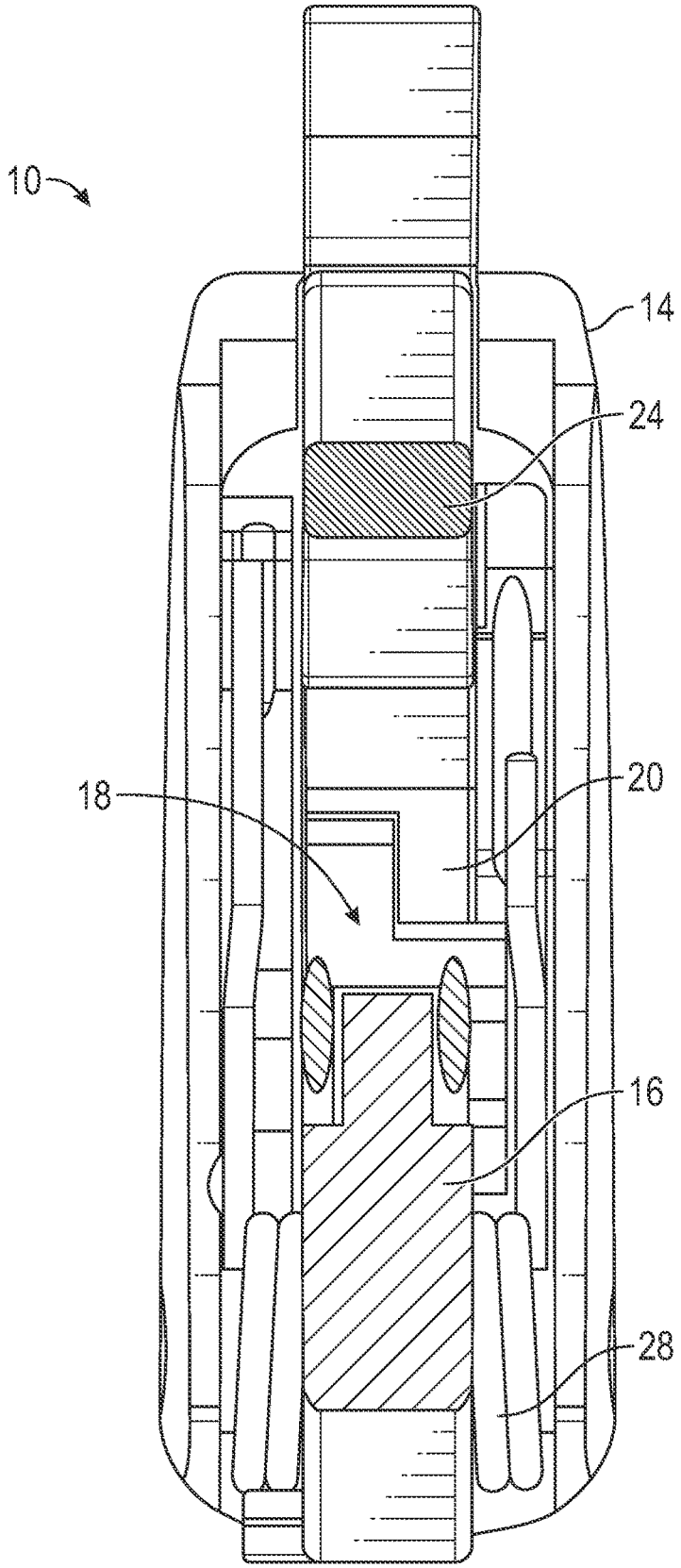
FIG. 5 is a top sectional view of the firearm trigger assembly of FIG. 1.

An embodiment of the firearm trigger assembly of the present invention is shown and generally designated by the reference numeral 10.

FIGS. 1-5 illustrate the improved firearm trigger assembly 10 of the present invention. More particularly, FIG. 1 shows the firearm trigger assembly in use installed in a rifle 12 shown in dashed lines. In the current embodiment, the rifle is an AR-15 rifle. The firearm trigger assembly has a frame 14 with a hammer 16 pivotally connected to the frame and a trigger element 18 pivotally connected to the frame and operable to selectively restrain and release the hammer in response to movement of the trigger element between a restraint position and a release position. A trigger lever 20 is movably connected to the trigger element and is movable with respect to the trigger element between a first unactuated position and a second actuated position. The trigger element is configured to remain in the restraint position when the trigger lever is in the first unactuated position, in any of a range of positions intermediate the first unactuated position and the second actuated position, and when in the second actuated position with an application of force to the trigger lever below a selected force threshold. The trigger lever is also operable to move the trigger element to the release position in response to an application of force to the trigger lever greater than the selected force threshold.

In the current embodiment, the trigger lever 20 is biased to the first unactuated position, and the trigger element 18 has a lever portion 22 coextensive with the trigger lever. The lever portion of the trigger element extends adjacent to the trigger lever. The trigger lever has a free end 38 operable to contact a free end portion 36 of the lever portion of the trigger element to motivate the trigger element. Furthermore, the trigger element and trigger lever each have lever portions 22, 34 each having free ends 36, 38, and the free ends of each lever portion abut each other when the trigger lever is in the second actuated position.

A disconnector 24 is connected to the trigger lever 20. Both the trigger lever and the trigger element 18 pivot about a common axis 26. The free ends 36, 38 of both the trigger lever and the trigger element extend a common distance from the common axis. A hammer spring 28 is connected to the trigger lever to establish a first stage pull weight. A trigger element spring 30 biases the trigger element with respect to the frame 14 to establish the selected force threshold. The majority of threshold force comes from sear friction and pushing the hammer 16 out of the way, but any adjustability is from the trigger element spring, which is a small spring positioned underneath the trigger element. The trigger lever is biased by a second spring (the hammer spring) other than the trigger element spring. Thus, a first spring (the trigger element spring) intervenes between the trigger element and the frame, and a second spring (the hammer spring) intervenes between the hammer and the trigger lever.

The firearm trigger assembly 10 is assembled into a single unit that can be readily installed into a host rifle 12 for easy assembly. The two-stage trigger functionality is divided into two separate movements to fully release the hammer 16 and fire the rifle. The trigger element 18 and trigger lever 20 operate independently of each other. Therefore, the first stage and second stage trigger movements are separate moving parts. The trigger lever is partially received by the trigger element in varying amounts as the trigger lever's position moves between the first unactuated position and the second actuated position.

To assemble the firearm trigger assembly 10, a disconnector spring 40 is inserted into a spring hole 42 in the trigger lever 20 to bias the disconnector forward. The disconnector 24 is then slid onto the trigger lever, and a disconnector pin 44 secures the disconnector in place. The trigger lever is then interlocked into the trigger element 18 by rotating, sliding them together, rotating the opposite direction, and finally sliding the trigger element upwards to align the bushing holes 46, 48. The trigger element includes a ring-shaped feature 50 that is raised above the main surface 52 by a small amount. The ring-shaped feature minimizes surface friction between the trigger lever and the trigger element, which allows for more force control during assembly and in use for shooting. An additional ring-shaped feature is present on the opposed side of the trigger element to minimize surface friction when interacting with a safety catch 54.

Subsequently, a trigger link 56 (shown in FIGS. 7A-E) is installed on the trigger lever 20 and is held in place rigidly by a socket cap screw 58. Location 60 on the trigger lever interacts with location 62 on the trigger link to prevent the rifle 12 from firing when force is applied to either the trigger lever or trigger element 18 while the rifle's safety is on. The trigger element spring 30 is then inserted into a spring hole 64 in the trigger element. The trigger element spring is secured by a set screw 66. The trigger element spring places tension on the trigger element. The force exerted by the trigger element spring is set independently of the tension of the trigger lever by adjusting the height of the set screw.

The safety catch 54 has an aperture 68 that aligns with the bushing holes 46, 48 of the trigger element 18 and trigger lever 20. The alignment is maintained by a bushing 70 that will be installed later, which allows for rotation about the bushing. The rear 72 of the safety catch sits on a portion 74 of the disconnector pin 44. When the trigger lever is pulled, the front 76 of the safety catch rotates downward. The safety catch serves as a drop safety and prevents any inadvertent striking of the firing pin if the hammer 16 were to ever disengage from the trigger sear 78 on the trigger element unintentionally. The safety catch stops the hammer in a position where, even if the hammer were to be released from that position, the hammer lacks sufficient energy to discharge the rifle 14. The safety catch ensures the trigger lever and trigger element must be intentionally pulled for the rifle to fire.

The components that have been assembled thus far into a subassembly are subsequently placed in the frame 14. A bushing 80 will be inserted into the bushing holes 82, 84 defined by the frame to hold the subassembly in place. Compression springs 32 are then installed into the bottom 86 of the frame. The compression springs make installation of the firearm trigger assembly 10 in the rifle 14 easy, consistent, and secure. The compression springs place upward tension on the bottom rear of the frame, which applies consistent force to the bushings and the trigger pins in the receiver of the rifle. The hammer 16 and hammer spring 28 are then installed in the frame. The hammer spring provides force for the hammer, the safety catch 54, and the trigger lever 20. A full-length spring leg 86 of the hammer spring rests on the safety catch, which keeps the rear 72 safety catch firmly pressed into the portion 74 of the disconnector pin 44. The full-length spring leg also provides most of the pull weight of the trigger lever 20. A shorter length spring leg 88 rests on the trigger link 56 and contributes minimally to the pull weight of the trigger lever because the shorter length spring leg terminates so close to the common axis 26. Finally, the bushings 70, 80 are installed by inserting them in the various bushing holes in the components and frame.

Figure 6A:
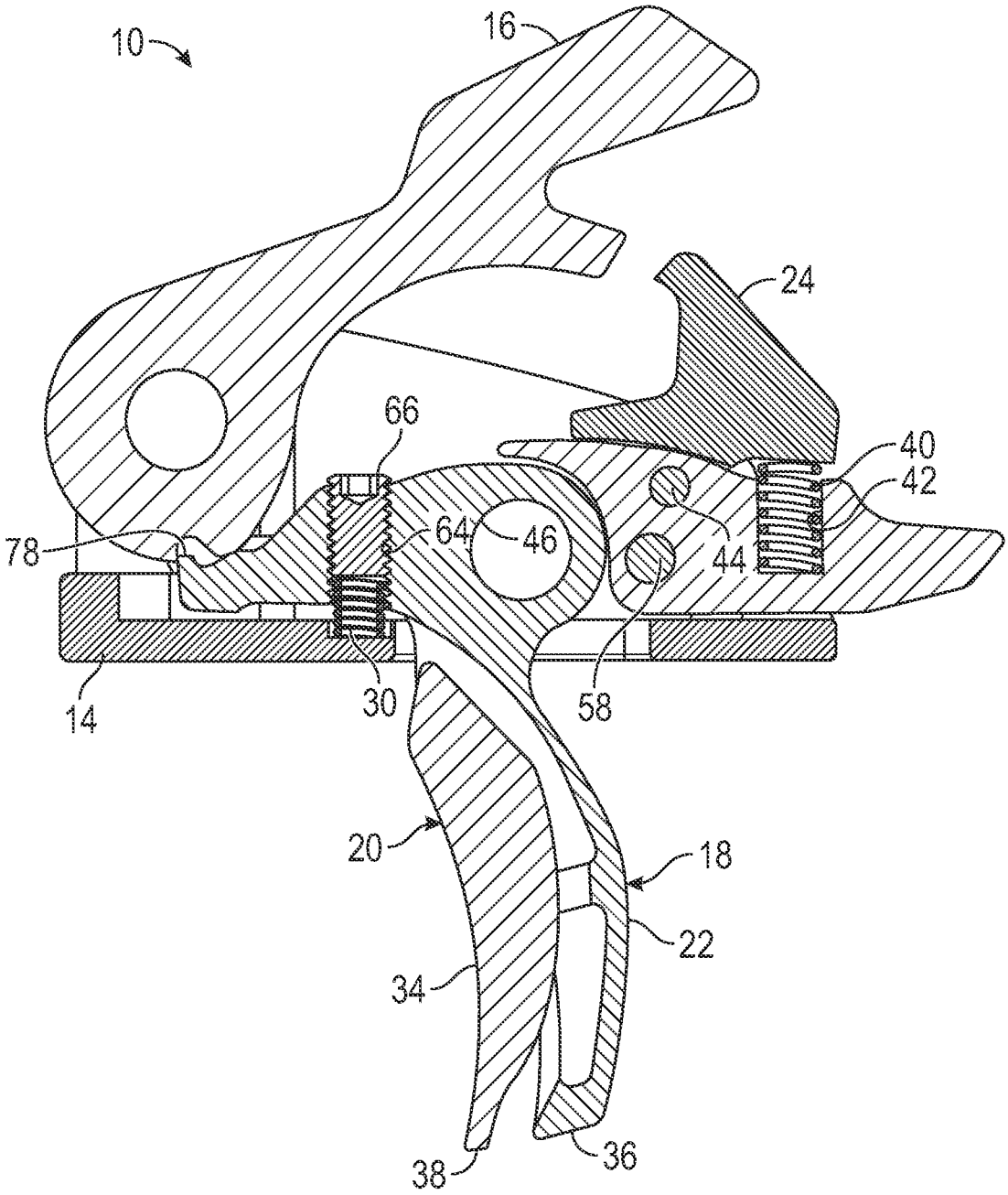
FIG. 6A is a side sectional view of the firearm trigger assembly of FIG. 1 in the first unactuated position.
Figure 6B:
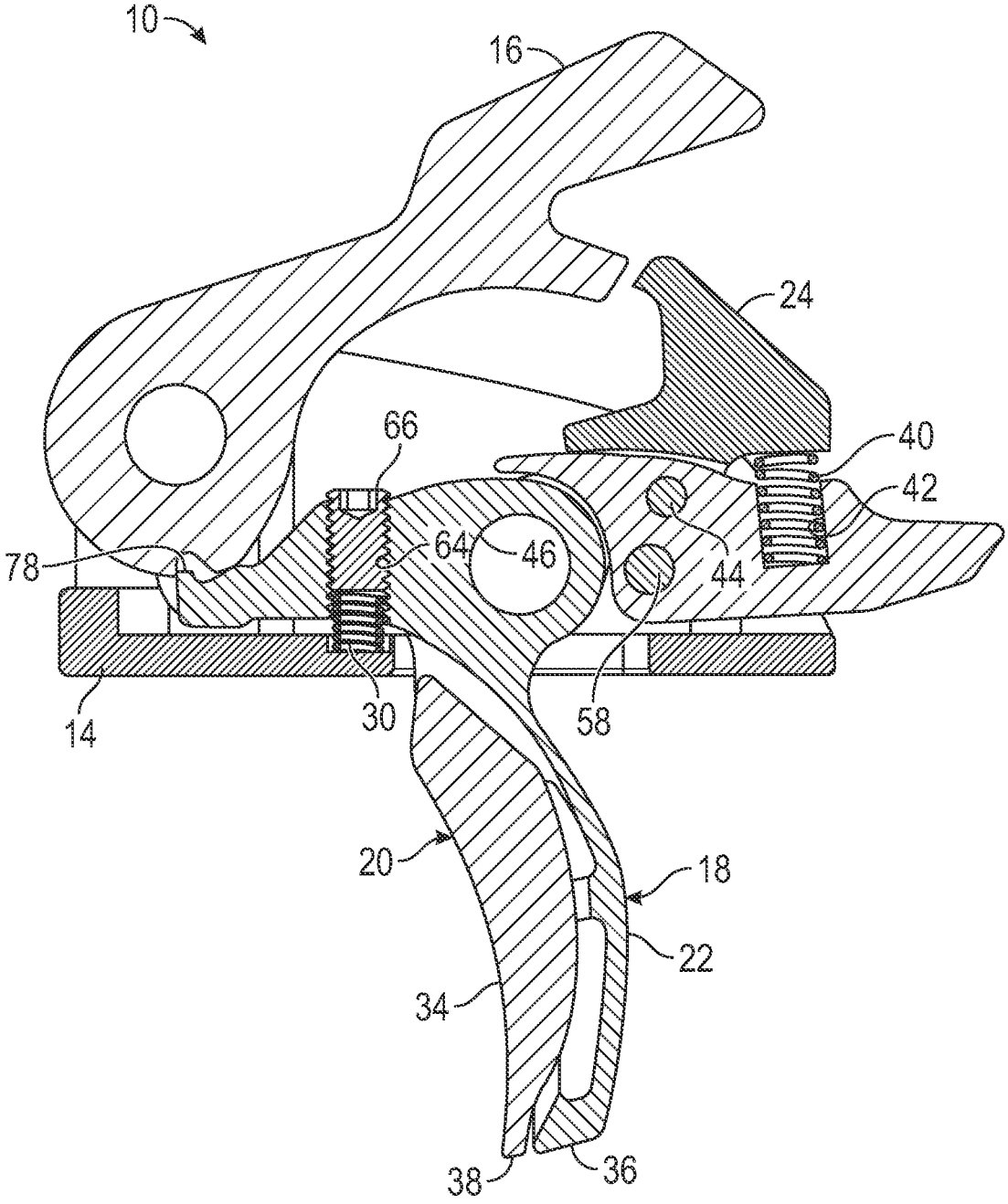
FIG. 6B is a side sectional view of the firearm trigger assembly of FIG. 1 showing the trigger lever in one of a range of positions intermediate the first unactuated position and the second actuated position.
Figure 6C:
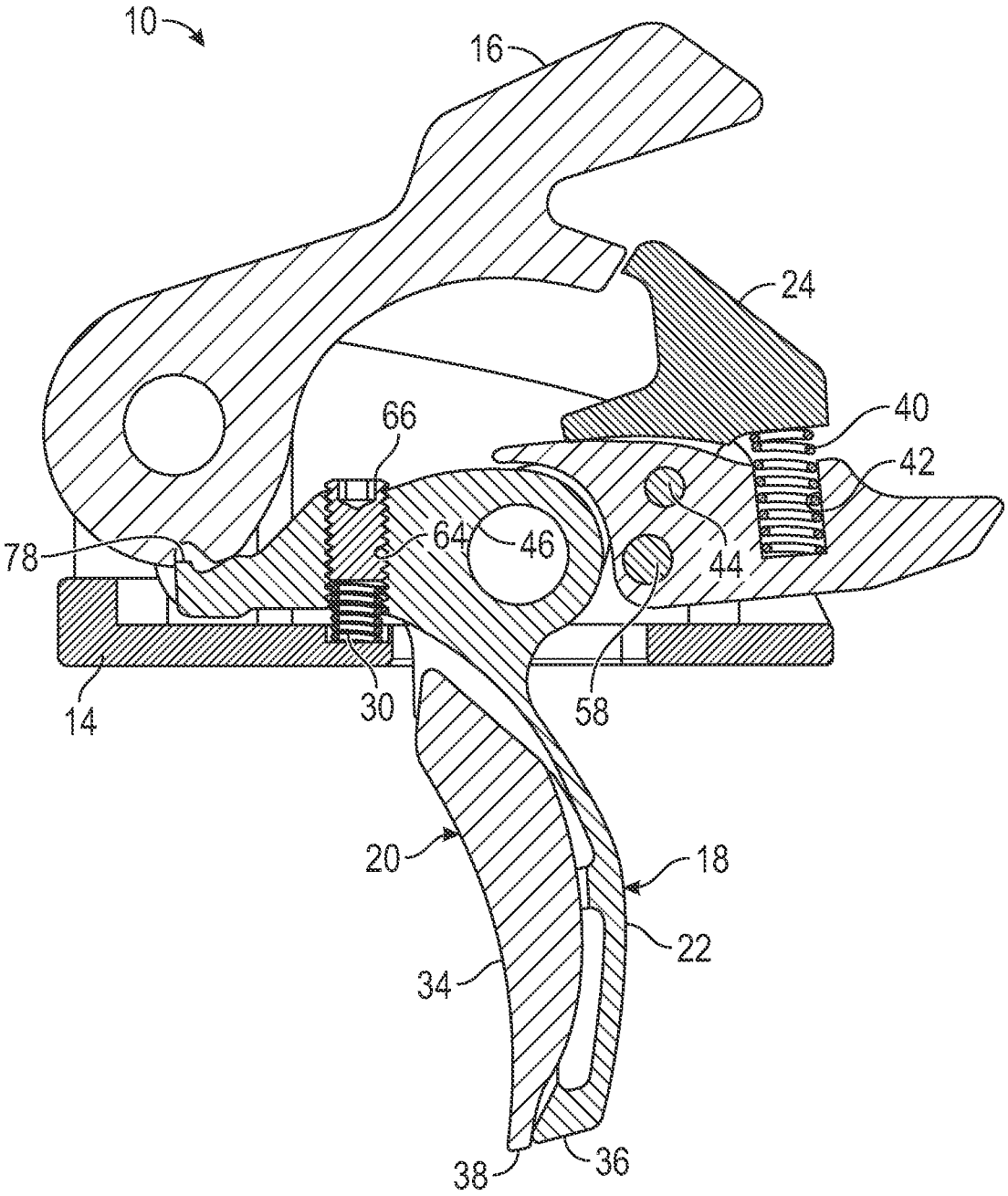
FIG. 6C is a side sectional view of the firearm trigger assembly of FIG. 1 showing the trigger lever in the second actuated position with an application of force to the trigger lever below a selected force threshold.
Figure 6D:
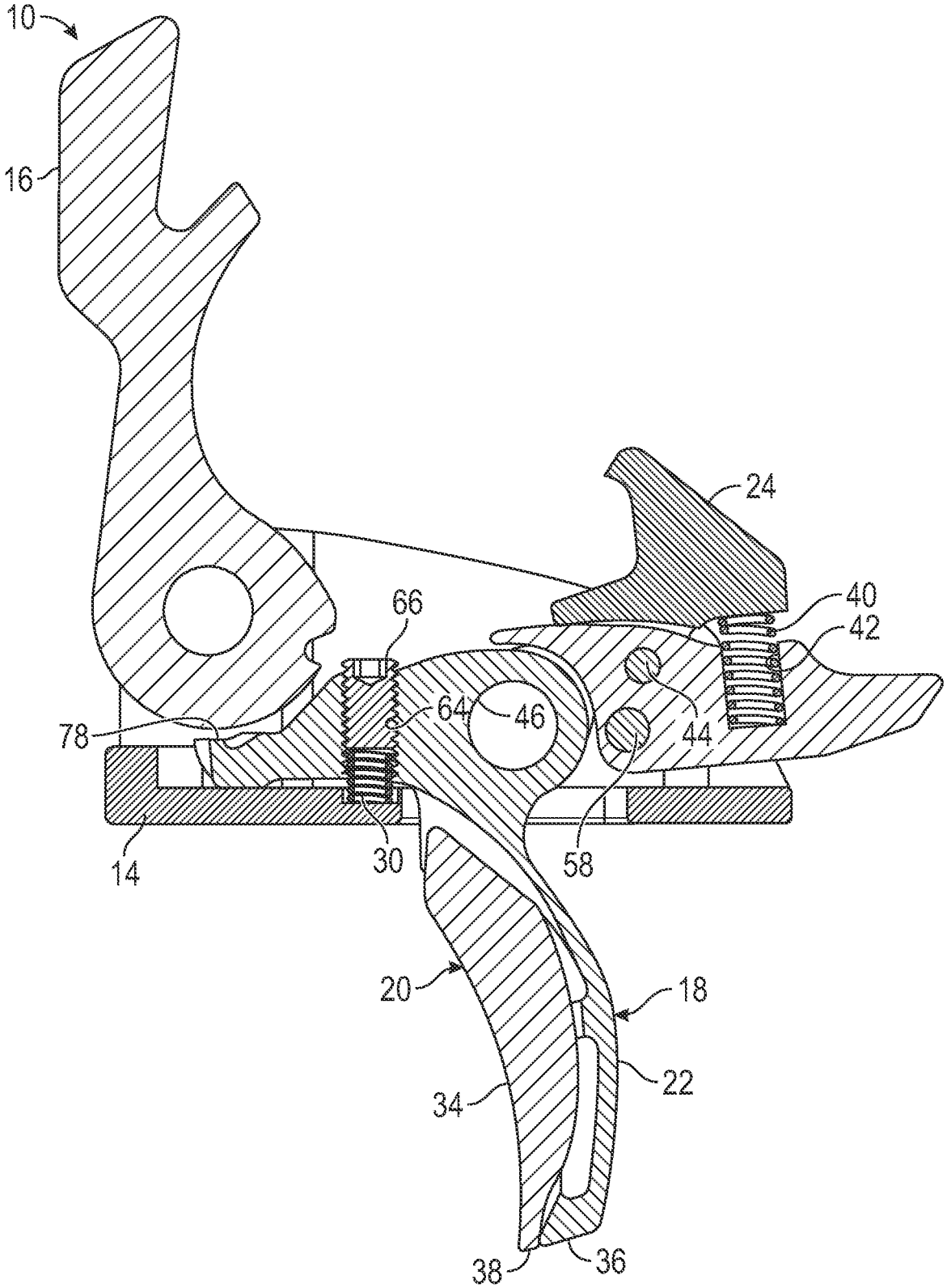
FIG. 6D is a side sectional view of the firearm trigger assembly of FIG. 1 showing the trigger lever in the second actuated position with an application of force to the trigger lever greater than the selected force threshold such that the sear has released the hammer.
Figure 6E:
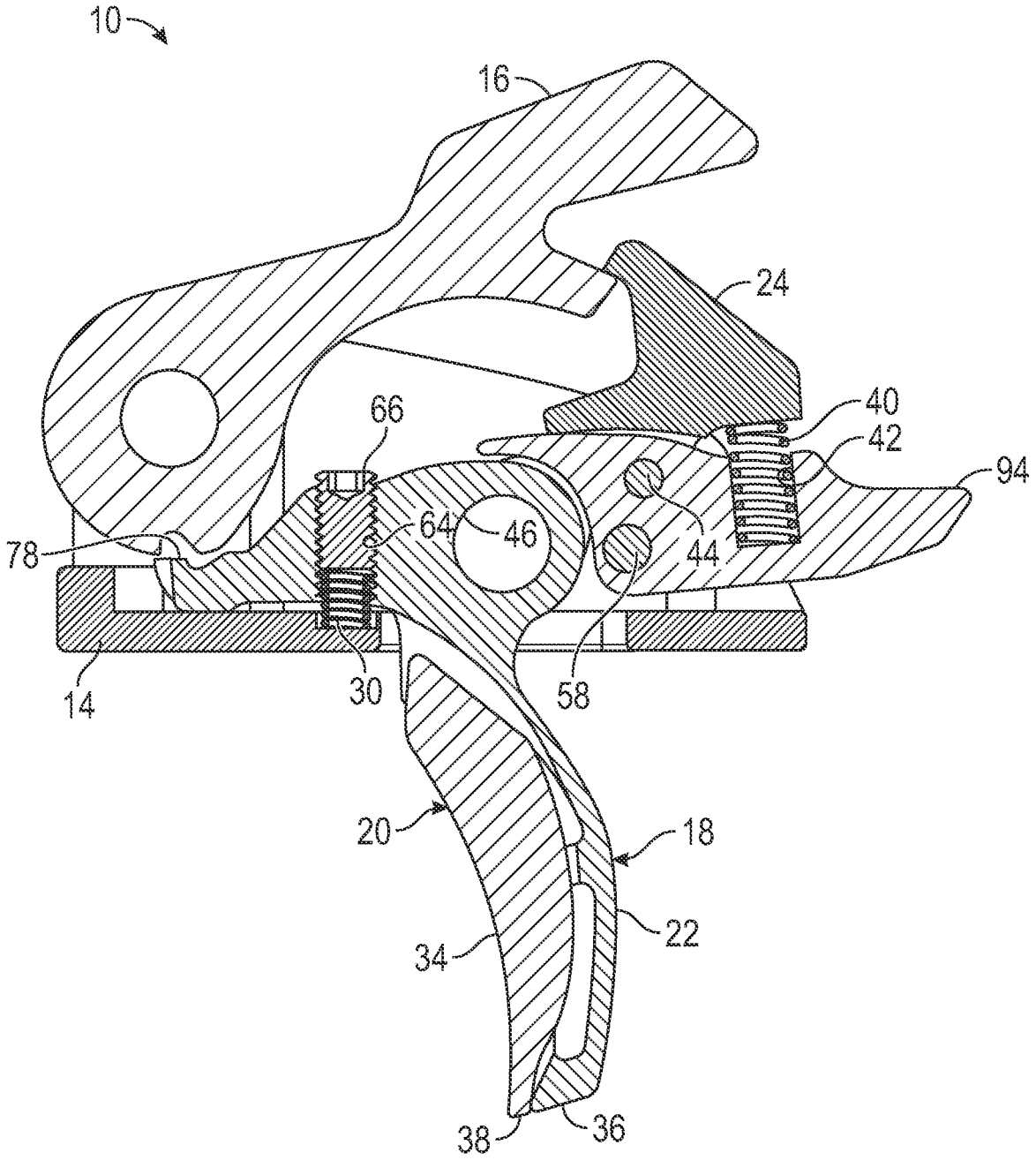
FIG. 6E is a side sectional view of the firearm trigger assembly of FIG. 1 showing the trigger lever in the second actuated position with an application of force to the trigger lever greater than the selected force threshold. The hammer has recoiled under the influence of the rifle action and has been caught by the disconnector.
Figure 7A:
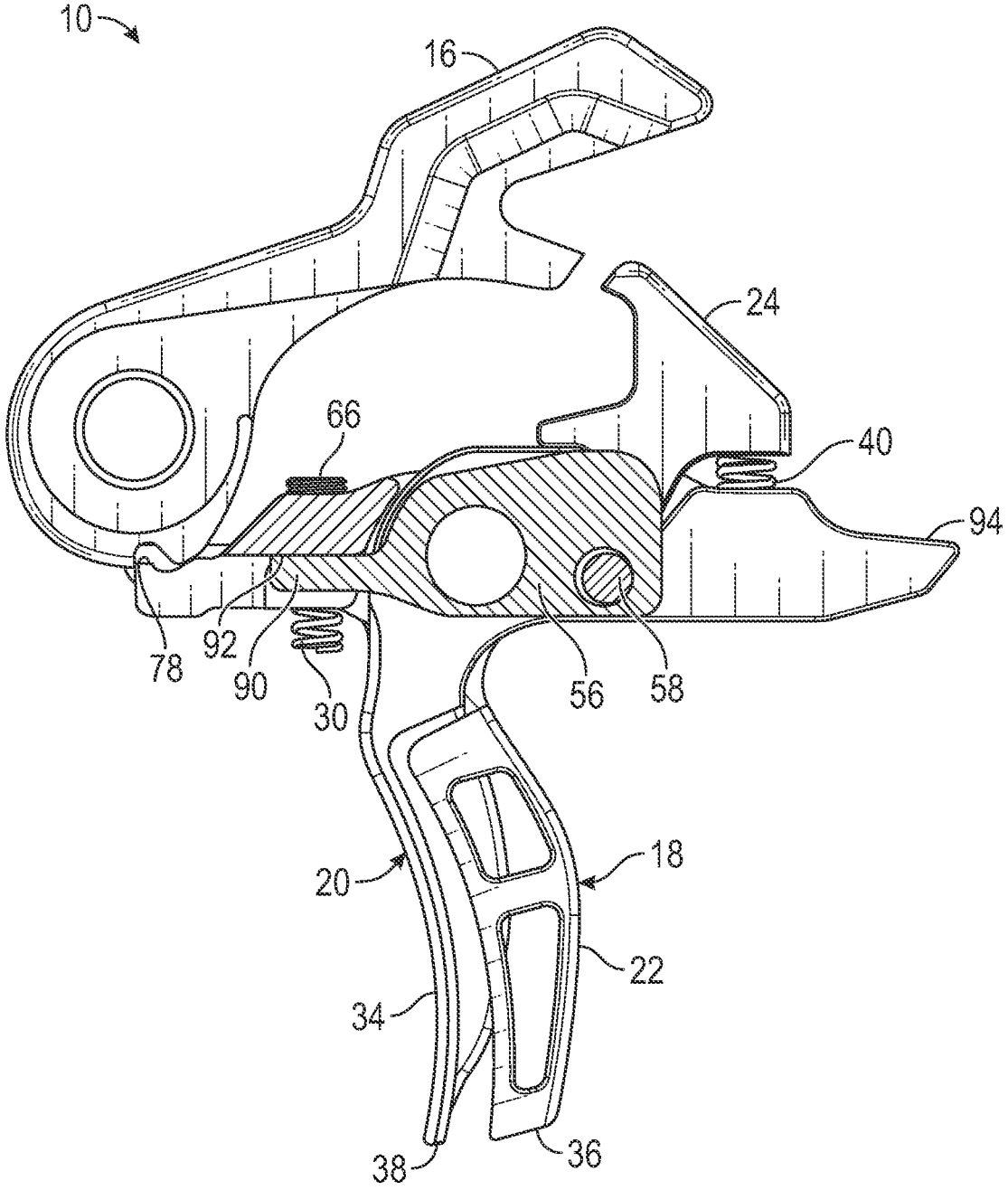
FIG. 7A is a side sectional view of the firearm trigger assembly of FIG. 1 in the first unactuated position.
Figure 7B:
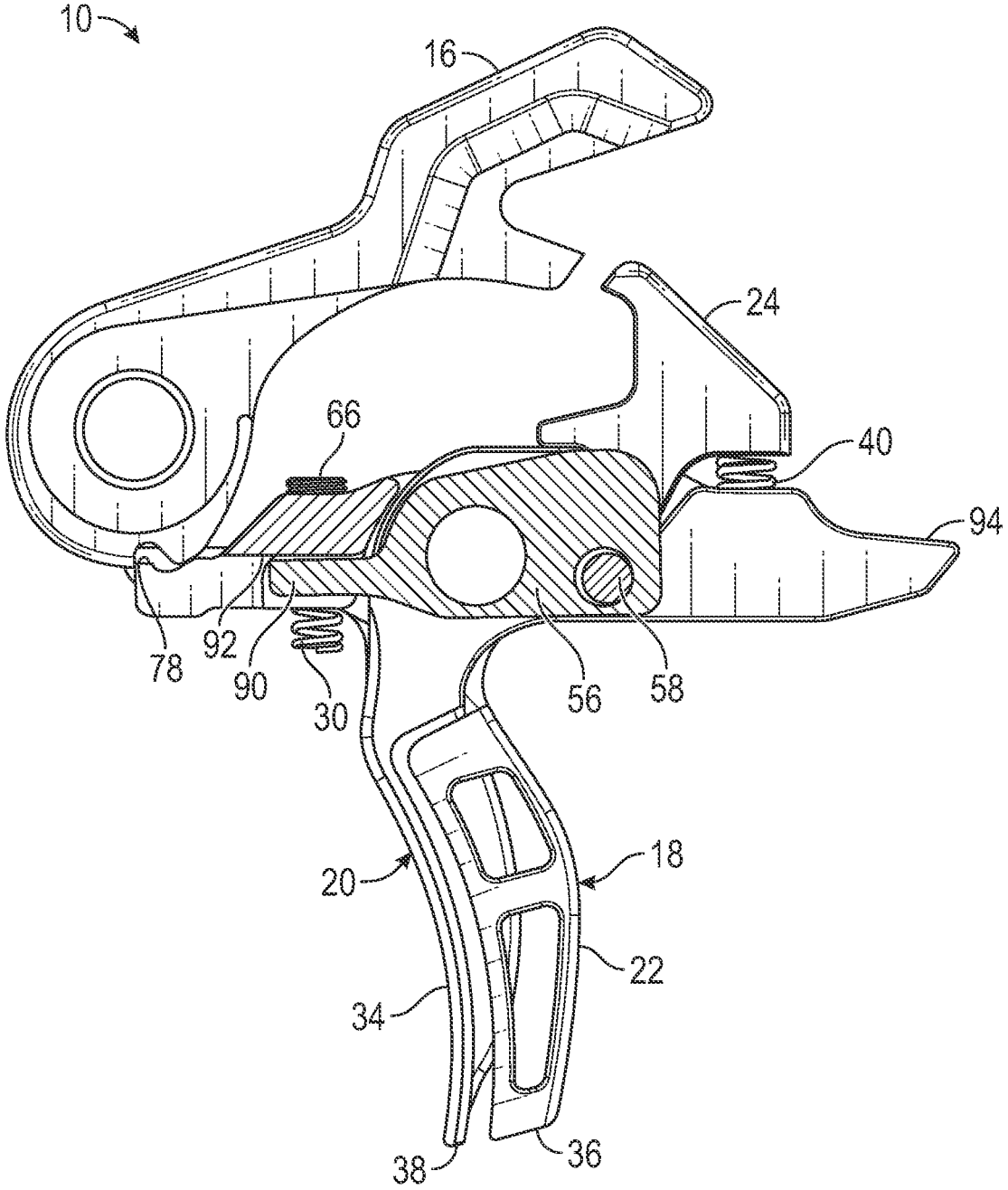
FIG. 7B is a side sectional view of the firearm trigger assembly of FIG. 1 showing the trigger lever in one of a range of positions intermediate the first unactuated position and the second actuated position.
Figure 7C:
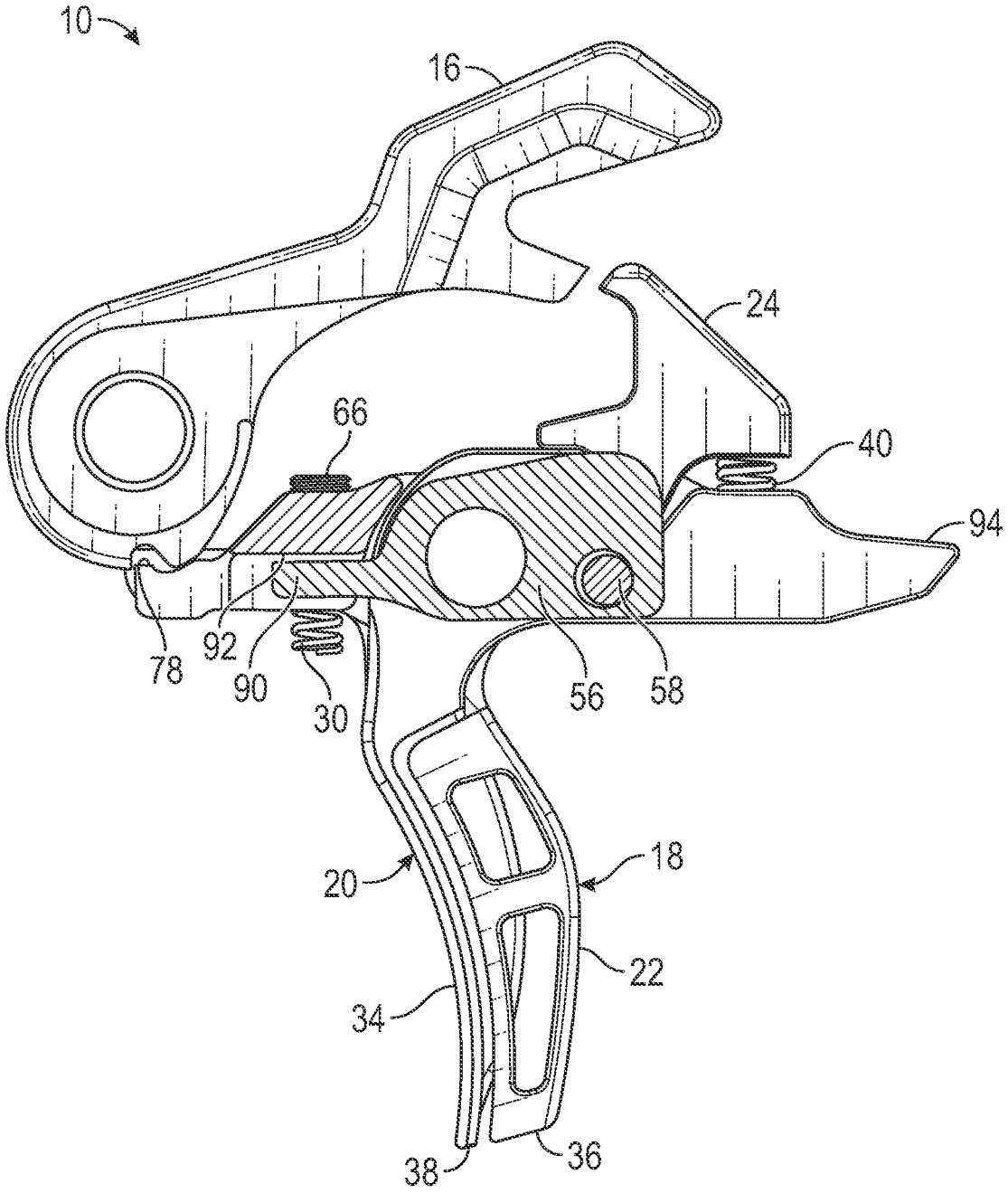
FIG. 7C is a side sectional view of the firearm trigger assembly of FIG. 1 showing the trigger lever in another one of a range of positions intermediate the first unactuated position and the second actuated position.
Figure 7D:
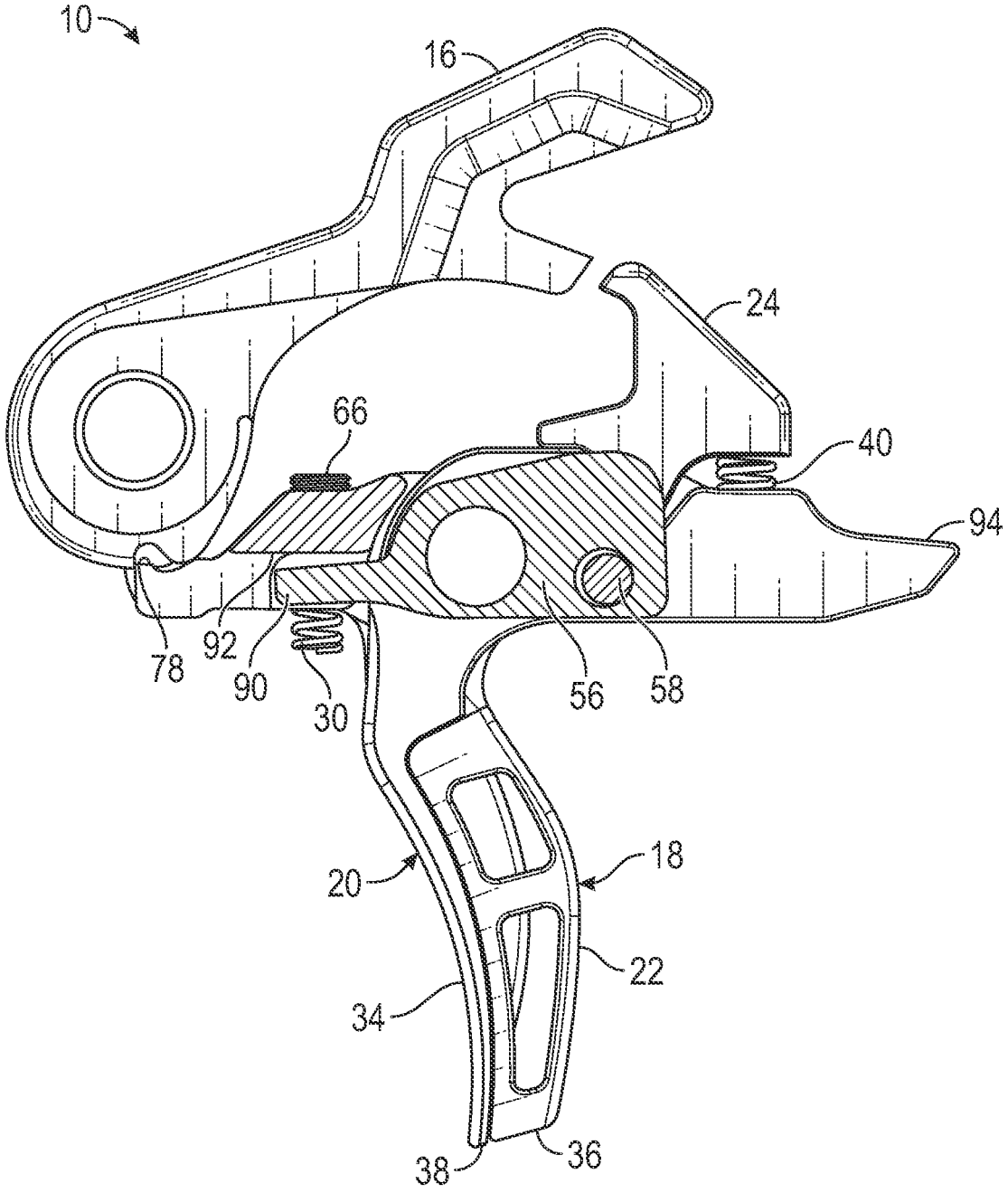
FIG. 7D is a side sectional view of the firearm trigger assembly of FIG. 1 showing the trigger lever in the second actuated position with an application of force to the trigger lever below a selected force threshold.
Figure 7E:
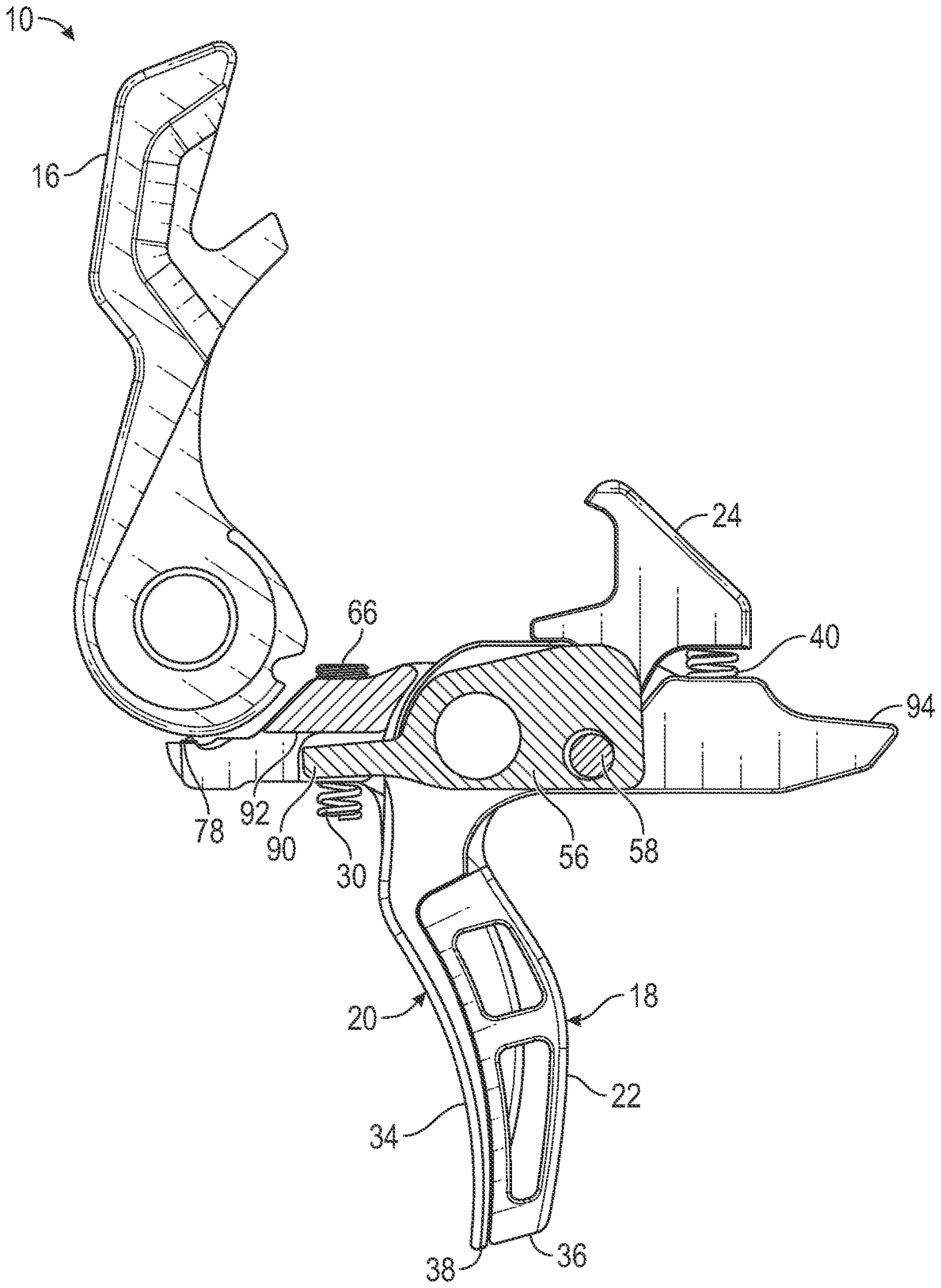
FIG. 7E is a side sectional view of the firearm trigger assembly of FIG. 1 showing the trigger lever in the second actuated position with an application of force to the trigger lever greater than the selected force threshold such that the sear has released the hammer.
Figure 7F:
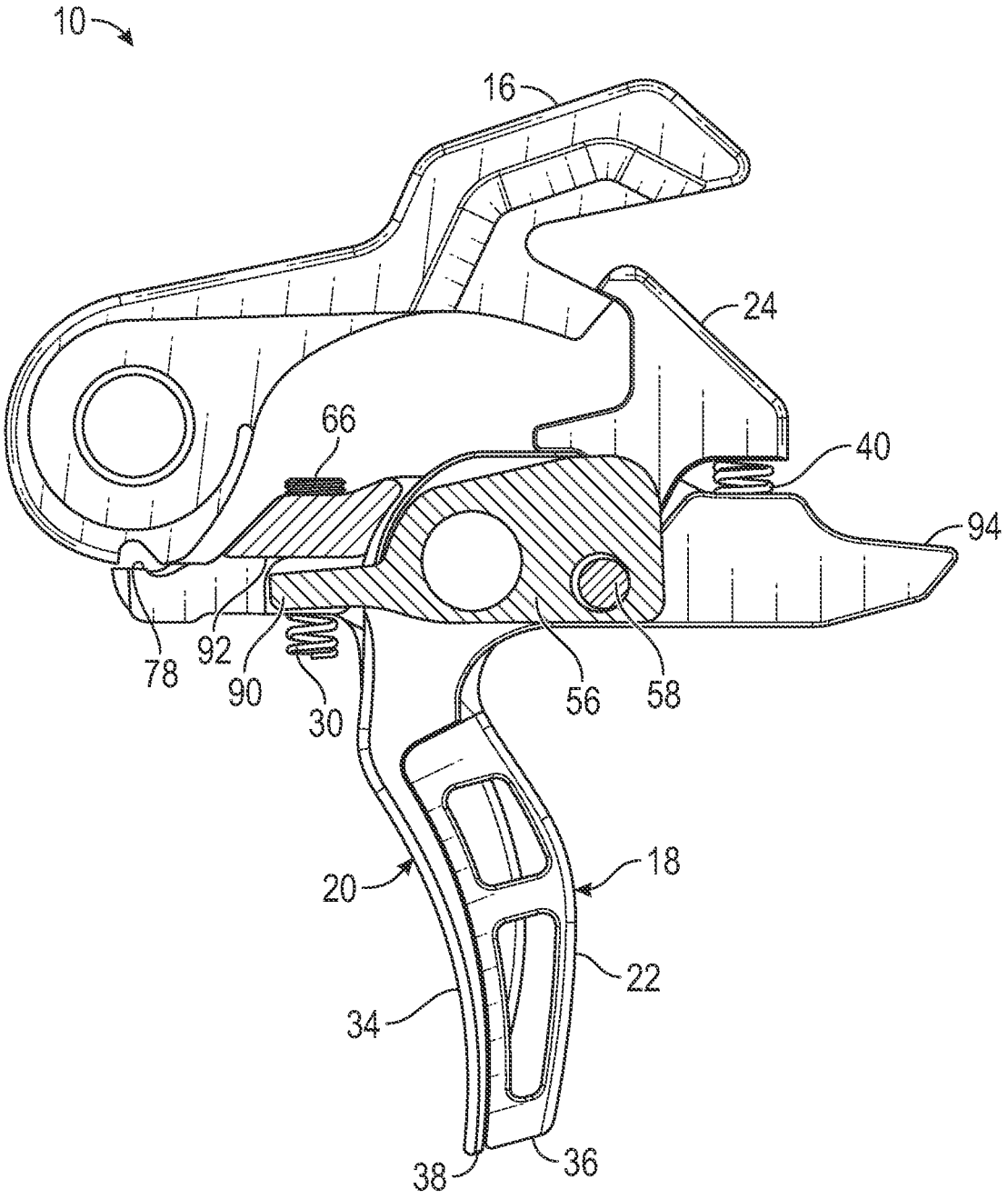
FIG. 7F is a side sectional view of the firearm trigger assembly of FIG. 1 showing the trigger lever in the second actuated position with an application of force to the trigger lever greater than the selected force threshold. The hammer has recoiled under the influence of the rifle action and has been caught by the disconnector.

FIGS. 6A-E and 7A-E illustrate the improved firearm trigger assembly 10 of the present invention. More particularly, FIGS. 6A and 7A show the trigger lever 20 in the first unactuated position ready to fire. FIGS. 6B and 7B show the trigger lever partially pulled rearward in one of a range of positions intermediate the first unactuated position and the second actuated position. The trigger lever has not yet encountered the trigger element 18, which has remained stationary. FIG. 7C shows the trigger lever partially pulled rearward in another one of a range of positions intermediate the first unactuated position and the second actuated position. The trigger lever has not yet encountered the trigger element 18, which has remained stationary. The trigger link 56 has begun to separate from contacting the trigger element. FIGS. 6C and 7D show the trigger lever bottomed out against the trigger element in the second actuated position with an application of force to the trigger lever below a selected force threshold. The first stage of trigger pull is complete, and the user experiences increased resistance indicating that increased force will be required to perform the second stage of trigger pull to discharge the rifle 14. The contact between the trigger lever and trigger element also provides a visual indication the first stage of trigger pull is complete. FIGS. 6D and 7E show the trigger lever having moved the trigger element to the release position in response to an application of force to the trigger lever greater than the selected force threshold. The hammer has been released by the trigger sear to discharge the rifle. FIGS. 6E and 7F show the hammer has recoiled under the influence of the rifle action and has been caught by the disconnector 24. Once the trigger lever and trigger element have been released by the shooter, the hammer retention function will be transitioned from the disconnector to the trigger sear as the trigger lever and trigger element returned to the first unactuated position illustrated in FIGS. 6A and 7A. The current invention allows the trigger element to be in contact with the hammer prior to the hammer releasing from the disconnector, which is a unique feature. Furthermore, the trigger lever does not have to fully return to its start position before the hammer resets. This allows for faster follow up shots that traditional 2-stage triggers cannot achieve.

It should be appreciated that the trigger link 56 is critical to the proper function of the firearm trigger assembly 10. The trigger link is mounted on the trigger lever 20 using two locating bosses on the trigger link and a corresponding slot and hole on the trigger lever and is secured by the socket cap screw 58. Once the trigger link is rigidly mounted on the trigger lever, an extended ledge 90 on the trigger link interfaces with a shelf 92 on the trigger element 18 and prohibits the trigger element from moving without the trigger lever (and by connection the trigger link) moving first. Therefore, with the safety catch 54 on safe, a back safety flat 94 on the trigger lever will not be able to move up, so neither the trigger lever nor the trigger element can be pulled without first disengaging the safety catch. Once the safety catch is off, the trigger lever can be pulled and will move the ledge on the trigger link completely out of the way of the shelf on the trigger element, allowing the trigger sear 78 to move downward and release the hammer 16.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a firearm trigger assembly has been described in detail, it should be apparent that modifications and variations thereto are possible, all of which fall within the true spirit and scope of the invention. Although rifles have been disclosed, the firearm trigger assembly is also suitable for use with any other firearm type where a two-stage trigger would be beneficial. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A trigger assembly for a firearm comprising:

a frame;

a hammer pivotally connected to the frame;

a trigger element pivotally connected to the frame and operable to selectively restrain and release the hammer in response to movement of the trigger element between a restraint position and a release position;

a trigger lever movably connected to the trigger element and movable with respect to the trigger element between a first unactuated position and a second actuated position;

the trigger element being configured to remain in the restraint position when the trigger lever is in the first unactuated position, in any of a range of positions intermediate the first unactuated position and the second actuated position, and when in the second actuated position with an application of force to the trigger lever below a selected force threshold; and the trigger lever being operable to move the trigger element to the release position in response to an application of force to the trigger lever greater than the selected force threshold.

2. The trigger assembly of claim 1 wherein the trigger lever is biased to the first unactuated position.

3. The trigger assembly of claim 1 wherein the trigger element has a lever portion coextensive with the trigger lever.

4. The trigger assembly of claim 3 wherein the trigger lever has a free end operable to contact a free end portion of the lever portion of the trigger element to motivate the trigger element.

5. The trigger assembly of claim 1 including a disconnector connected to the trigger lever.

6. The trigger assembly of claim 1 wherein both the trigger lever and the trigger element pivot about a common axis.

7. The trigger assembly of claim 1 including a hammer spring connected to the trigger lever to establish a first stage pull weight.

8. The trigger assembly of claim 1 including a trigger element spring biasing the trigger element with respect to the frame to establish the selected force threshold.

9. The trigger assembly of claim 8 wherein the trigger lever is biased by a second spring other than the trigger element spring.

10. The trigger assembly of claim 1 including a first spring intervening between the trigger element and the frame, and a second spring intervening between the hammer and the trigger lever.

11. The trigger assembly of claim 1 wherein the trigger element has a lever portion extending adjacent to the trigger lever.

12. The trigger assembly of claim 1 wherein the trigger lever and trigger element each have lever portions each having free ends, and wherein the free ends of each lever portion abut each other when the trigger lever is in the second actuated position.

13. The trigger assembly of claim 12 wherein both the trigger lever and the trigger element pivot about a common axis, and the free ends of the trigger lever and the trigger element extend a common distance from the common axis.

* * * * *